US009952551B2

(12) United States Patent
Iriyama et al.

(10) Patent No.: US 9,952,551 B2
(45) Date of Patent: Apr. 24, 2018

(54) IMAGE FORMING APPARATUS FOR PERFORMING SCRAPING PROCESS TO SCRAPE PHOTOSENSITIVE MEMBER

(71) Applicant: BROTHER KOGYO KABUSHIKI KAISHA, Nagoya, Aichi (JP)

(72) Inventors: Shota Iriyama, Toyokawa (JP); Kengo Yada, Seki (JP); Yuichi Matsushita, Nagoya (JP); Chieko Mimura, Nagoya (JP); Hiroshige Hiramatsu, Inuyama (JP); Hotaka Kakutani, Kiyosu (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/412,683

(22) Filed: Jan. 23, 2017

(65) Prior Publication Data

US 2017/0212467 A1 Jul. 27, 2017

(30) Foreign Application Priority Data

Jan. 26, 2016 (JP) ..... 2016-012036
Jan. 12, 2017 (JP) ..... 2017-003140

(51) Int. Cl.
*G03G 21/00* (2006.01)

(52) U.S. Cl.
CPC ..... *G03G 21/0011* (2013.01)

(58) Field of Classification Search
CPC ..... G03G 21/0011
USPC ..... 399/71
See application file for complete search history.

(56) References Cited

U.S. PATENT DOCUMENTS

2006/0222381 A1* 10/2006 Moriya ..... G03G 15/0216 399/26
2007/0166058 A1* 7/2007 Ohmori ..... G03G 15/0266 399/26

FOREIGN PATENT DOCUMENTS

JP 06059606 A * 3/1994
JP 2006-234894 A 9/2006

OTHER PUBLICATIONS

Computer translation of JP2006-234894A; Sep. 2006; to Maruyama et al.*

* cited by examiner

*Primary Examiner* — Quana M Grainger
(74) *Attorney, Agent, or Firm* — Scully, Scott, Murphy & Presser, P.C.

(57) ABSTRACT

An image forming apparatus includes a photosensitive member, a charger, a developing device, a transfer device, a scraper, and a controller. The controller performs an image formation process to form the developer image on the photosensitive member by using the developing device. The controller acquires, as a first value, at least one of a value of the charging current flowing in the charger and a value of the transferring current flowing in the transfer device. The controller calculates an accumulation current value by using result of an integral of a second value over time. The second value is an absolute value of the first value. The controller performs a scraping process in which the scraper scrapes the photosensitive member when the accumulation current value reaches a threshold value.

20 Claims, 6 Drawing Sheets

IMAGE FORMING APPARATUS FOR PERFORMING SCRAPING PROCESS TO SCRAPE PHOTOSENSITIVE MEMBER

CROSS REFERENCE TO RELATED APPLICATION

This application claims priorities from Japanese Patent Application No. 2016-012036 filed Jan. 26, 2016 and Japanese Patent Application No. 2017-003140 filed Jan. 12, 2017. The entire content of each of these priority applications is incorporated herein by reference.

TECHNICAL FIELD

The present disclosure relates to an image processing apparatus.

BACKGROUND

A conventional image forming apparatus includes a photosensitive member, a transferring device, and a scraper. In this image forming apparatus, a coefficient of dynamic friction of a surface of the photosensitive member increases as image formation operations are repeatedly performed. When the coefficient of dynamic friction increases, toner is hard to be removed from the surface of the photosensitive member, and resides on the surface of the photosensitive member. Once the toner resides on the surface of the photosensitive member, the toner on the surface of the photosensitive member moves to a sheet during a subsequent image formation operation, thereby reducing quality of the image.

In a conventional image forming apparatus, which is disclosed in Japanese Patent Application Publication No. 2006-234894, a scraper scrapes a surface of a photosensitive member in order to reduce a coefficient of dynamic friction when a torque current arrived at a prescribed value on the basis of an assumption that there is a correlation between the coefficient of dynamic friction of the surface of the photosensitive member and the torque of the photosensitive member.

SUMMARY

The torque of the photosensitive member varies not only by the coefficient of dynamic friction coefficient but also by other factors. Specifically, viscosity of lubricant applied around the axis of the photosensitive member varies depending on increase of the temperature of the photosensitive member. Even when the coefficient of dynamic friction of the surface of the photosensitive member is unchanged, the torque of the photosensitive member varies depending on the viscosity of lubricant applied around the axis of the photosensitive member caused by the increase of the temperature. According to the above mentioned conventional technique disclosed in Japanese Patent Application Publication No. 2006-234894, because the surface of the photosensitive member is scraped when the torque current of the photosensitive member arrived at the prescribed value, the photosensitive member is unnecessarily scraped even if the dynamic friction of the photosensitive member is too low to influence the image.

In view of the foregoing, it is an object of the present disclosure to provide a technique to reduce an unnecessary scraping operation while preventing degradation of a quality of an image.

In order to attain the above and other objects, the disclosure provides an image forming apparatus. The image forming apparatus includes a photosensitive member, a charger, a developing device, a transfer device, a scraper, and a controller. On the photosensitive member a developer image is configured to be formed. A charging current is configured to flow through the charger. The developing device is configured to supply developer to the photosensitive member. A transferring current is configured to flow through the transfer device. The scraper is configured to scrape the photosensitive member. The controller is configured to: perform an image formation process to form the developer image on the photosensitive member by using the developing device; acquire, as a first value, at least one of a value of the charging current flowing in the charger and a value of the transferring current flowing in the transfer device; calculate an accumulation current value by using result of an integral of a second value over time, the second value being an absolute value of the first value; and perform a scraping process in which the scraper scrapes the photosensitive member when the accumulation current value reaches a threshold value.

According to another aspects, the disclosure provides a method for controlling an image forming apparatus including: a photosensitive member on which a developer image is configured to be formed; a charger through which a charging current is configured to flow; a developing device configured to supply developer to the photosensitive member; a transfer device through which a transferring current is configured to flow; a scraper configured to scrape the photosensitive member; and a controller. The method includes performing an image formation process to form the developer image on the photosensitive member by using the developing device; acquiring, as a first value, at least one of a value of the charging current flowing in the charger and a value of the transferring current flowing in the transfer device; calculating an accumulation current value by using result of an integral of a second value over time, the second value being an absolute value of the first value; and performing a scraping process in which the scraper scrapes the photosensitive member when the accumulation current value reaches a threshold value.

According to still another aspects, the disclosure provides an image forming apparatus. The image forming apparatus includes a photosensitive member, a charger, a developing device, a transfer device, a cleaning blade, and a controller. The developer image is configured to be formed on the photosensitive member. A charging current is configured to flow through the charger. The developing device is configured to supply developer to the photosensitive member. A transferring current is configured to flow through the transfer device. The cleaning blade is disposed to be in contact with a photosensitive member. The controller is configured to: supply the charger with the charging current; control the developing device to supply the developer to the photosensitive member; supply the developing device with the transferring current; acquire, as a first value, at least one of a value of the charging current flowing in the charger and a value of the transferring current flowing in the transfer device; calculate an accumulation current value by using result of an integral of a second value over time, the second value being an absolute value of the first value; and perform a scraping process in which the photosensitive member rotates while the charging current and the transferring current are reduced in a case where the accumulation current value reaches a threshold value.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
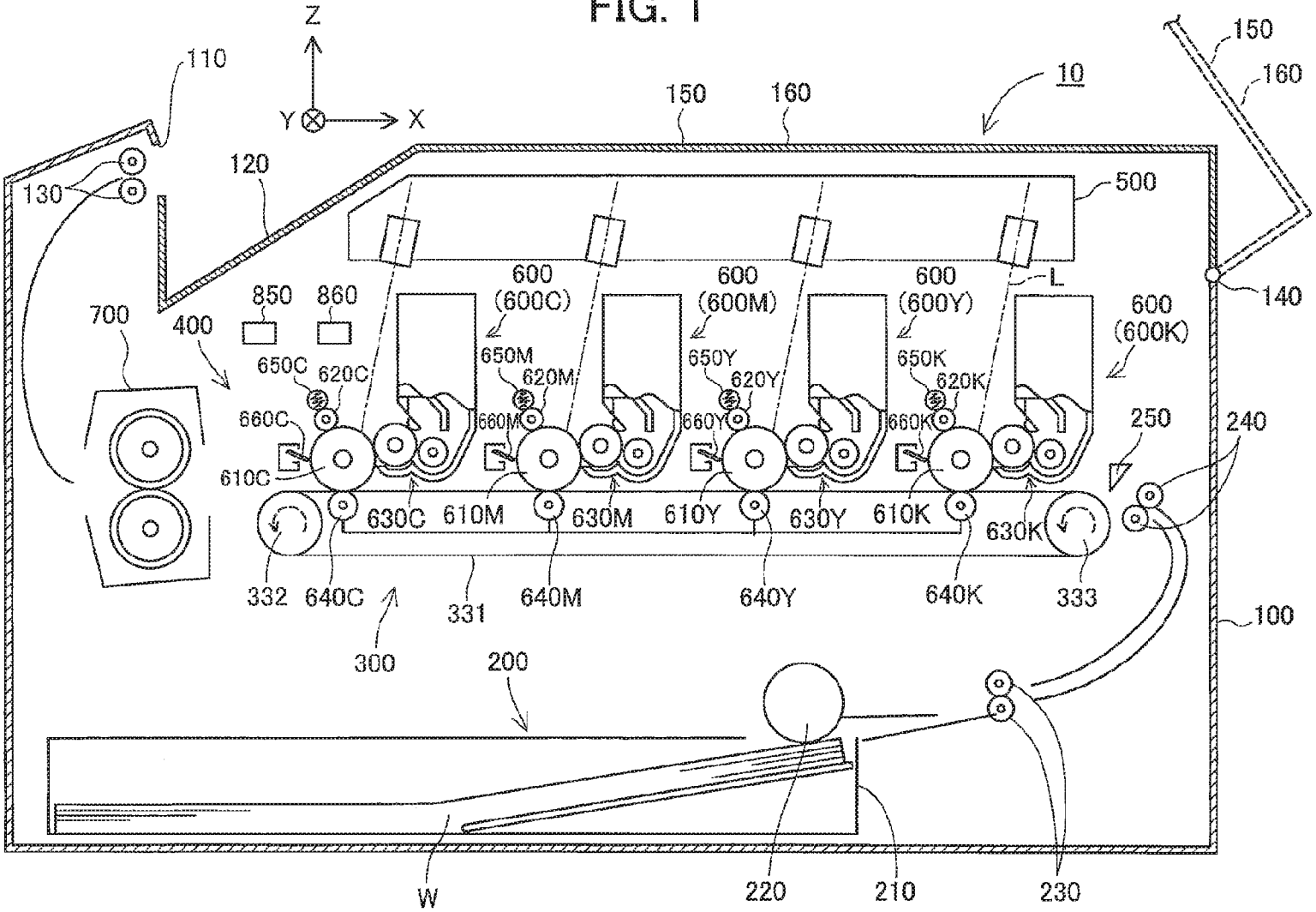
FIG. 1 is a schematic diagram illustrating an entire structure of a printer according to an embodiment.
Figure 2:
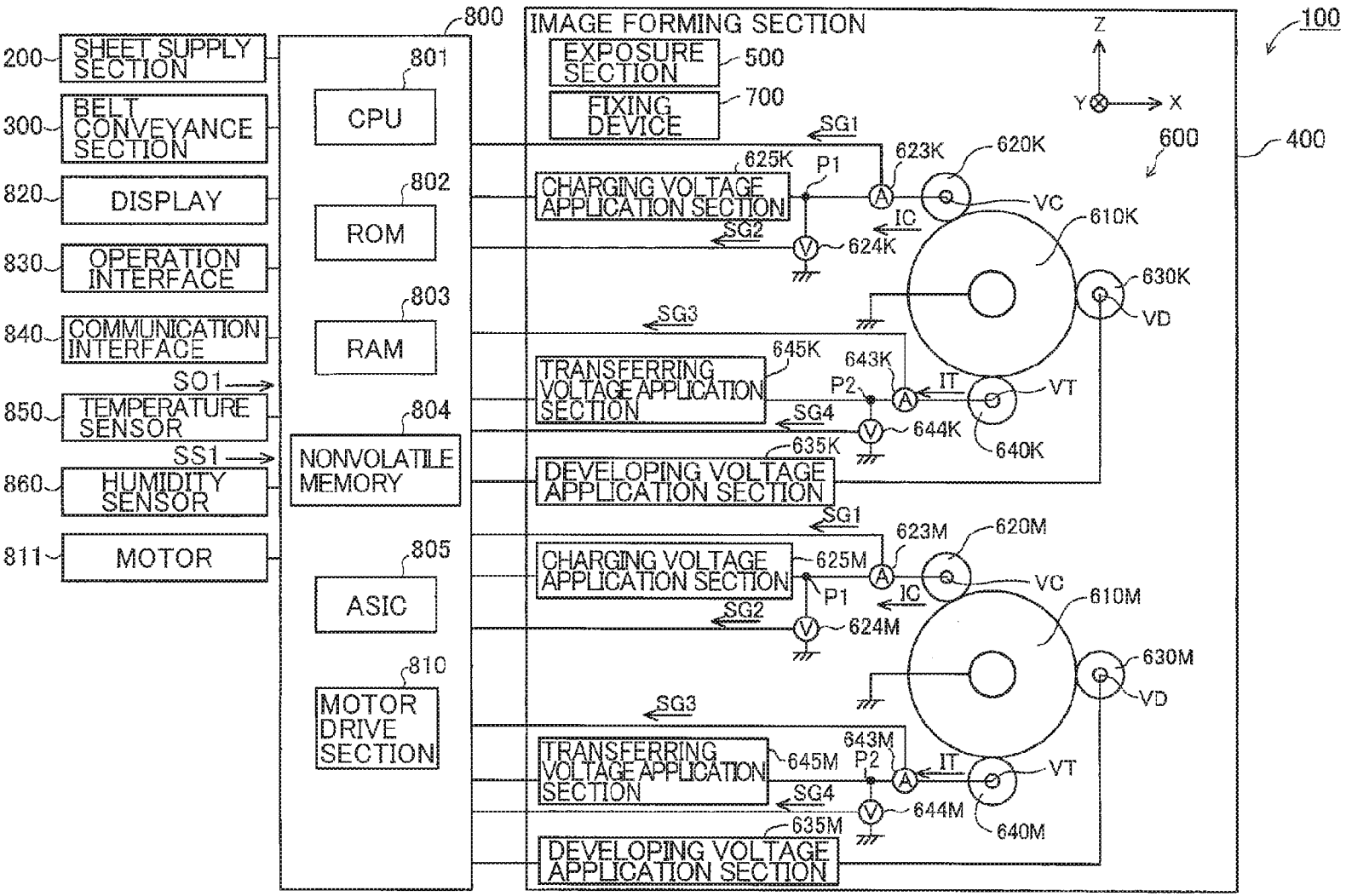
FIG. 2 is a block diagram illustrating electrical configuration of the printer according to the embodiment.

A printer 10 according to an embodiment will be explained. FIG. 1 is a schematic drawing illustrating an entire structure of the printer 10. In FIG. 1, X, Y, and Z axes are defined in order to specify respective directions. In the embodiment, a positive direction of the Z axis is an upper direction, a negative direction of the Z axis is a lower direction, a positive direction of the X axis is a front direction, a negative direction of the X axis is a rear direction, a positive direction of the Y axis is a right direction, and a negative direction of Y axis is a left direction. In FIG. 2, the X, Y, and Z axes are defined consistently with FIG. 1.

The printer 10 is an electrophotographic printer for forming an image on a sheet W, such as a recording sheet or an OHP sheet, by using toner (developing agent) of four colors, for example, black (K), yellow (Y), magenta (M), and cyan (C). The printer 10 is an example of an image forming apparatus. In the following explanations, if components have the same configurations except for color of the toner used therefor, a reference numeral of each of these components includes common numeral part and a symbol "K", "Y", "M", or "C", which indicates one of the colors black, yellow, magenta, and cyan, added to the end of the common numeral part for distinguishing colors of toner used for the components. In a case there is unnecessary to distinguish the color in the explanation, the symbols "K", "Y", "M", and "C" will be omitted appropriately. Further, from among components having the same configurations except for their colors, some components for a specific color are illustrated in the drawings as representatives and components for remaining colors are omitted from the drawings for simplicity.

As shown in FIG. 1, the printer 10 includes a main casing 100, a sheet supply section 200, a belt conveyance section 300, and an image forming section 400. The main casing 100 accommodates the sheet supply section 200, the belt conveyance section 300, and the image forming section 400. The main casing 100 includes a top cover 160 configuring a top surface 150 of the main casing 100. The top surface 150 is formed with an outlet 110 and a discharge tray 120. The main casing 100 accommodates discharge rollers 130 neighboring the outlet 110. A top cover 160 is pivotably moving so as to change between an open state and a closed state about an hinge 140 provided at front side of the main casing 100. A user can performs maintenance operations such as exchange of a photosensitive drum 610 or a developing device 630 by moving the top cover 160 to the open state, as described later. The main casing 100 is an example of an apparatus main body.

The sheet supply section 200 includes a tray 210, a pickup roller 220, conveyance rollers 230, registration rollers 240, and a sheet sensor 250. The tray 210 is a container for accommodating sheets W. The pickup roller 220 picks up one sheet W at a time from the tray 210. The conveyance rollers 230 convey the sheet W taken by the pickup roller 220 toward the registration rollers 240. The registration rollers 240 perform a skew correction on the sheet W conveyed from the conveyance rollers 230, and supply the sheet W to the belt conveyance section 300. The sheet sensor 250 is positioned between the registration rollers 240 and the belt conveyance section 300. The sheet sensor 250 detects presence or absence of the sheet W passing a detection position YS (see FIG. 7). The detection position YS is positioned between the registration rollers 240 and the belt conveyance section 300.

The belt conveyance section 300 includes a belt 331, a drive roller 332, and a follow roller 333. The drive roller 332 and the follow roller 333 are rotatable about respective axes parallel to each other. The belt 331 is a tubular belt, and mounted over the drive roller 332 and the follow roller 333 under tension. The belt 331 is circulated by the rotation of the drive roller 332. The sheet W is conveyed by the registration rollers 240 to an outer surface of the belt 331 facing the plurality of photosensitive drums 610. Further, the sheet W is conveyed to a fixing device 700 (described later) according to circulation of the belt 331. In the belt conveyance section 300, a plurality of transfer rollers 640 for four colors is provided. The plurality of transfer rollers 640 configures a process section 600 of the image forming section 400.

The image forming section 400 includes an exposure section 500, four process sections 600 (600K, 600Y, 600M, and 600C) for respective colors, and the fixing device 700. The exposure section 500 irradiates laser light L (light beam) to each photosensitive drum 610 provided for the corresponding process section 600.

The four process sections 600 are arranged in a conveying direction of the sheet W by the belt 331 (that is, a rearward). In the following explanations, the process section 600K for black will be explained as a representative. The process sections 600 for remaining colors have the same configuration as the process section 600K and thus detailed explanations thereof will be omitted.

The process section 600K includes a photosensitive drum 610K, a charging roller 620K, a developing device 630K, and a transfer roller 640K. The photosensitive drum 610K is rotatably provided in the main casing 100 and can be exchanged to another one by being detached from the main casing 100. The charging roller 620K is provided so as to be in contact with a surface of photosensitive drum 610K and to uniformly charge the surface of the photosensitive drum 610K. Hereinafter, a "charging position YA" (FIG. 7) designates a position on the surface of the photosensitive drum 610K where the photosensitive drum photosensitive drum photosensitive drum 610K is in contact with the charging roller 620K. The developing device 630K accommodates toner and supplies charged toner on the surface of the photosensitive drum 610K. Hereinafter, a "developing position YB" (FIG. 7) designates a position on the surface of the photosensitive drum 610K to which the developing device 630K supplies the toner. The developing device 630K is movable between a contact position and a separation position. The developing device 630K contacts the photosensitive drum 610K so as to supply the toner at the contact position. The developing device 630K is separated from the photosensitive drum 610K at the separation position. The transfer roller 640K is opposite to the surface of the photosensitive drum 610K with the belt 331 interposed between the transfer roller 640K and the photosensitive drum 610K. Hereinafter, a "transfer position YC" (see FIG. 7) designates a position on the surface of the photosensitive drum 610K to which the transfer roller 640K opposite with the belt 331 interposed between the transfer roller 640K and the photosensitive drum 610K. The photosensitive drum 610K for black is an example of a first photosensitive member. The photosensitive drums 610Y, 610M, and 610C for yellow, magenta, and cyan are examples of a second photosensitive member. The charging roller 620 is an example of a charger. The charging roller 620K for black is an example of a first charger. The charging rollers 620Y, 620M, 620C for yellow, magenta, and cyan are examples of a second charger. The transfer roller 640 is an example of a transfer device. The transfer roller 640K for black is an example of a first transfer device. The transfer rollers 640Y, 640M, and 640C for yellow, magenta, and cyan are examples of a second transfer device.

When the exposure section 500 irradiates the laser light L onto the surface of the photosensitive drum 610K charged by the charging roller 620K, an electrostatic latent image is formed on the surface of the photosensitive drum 610K. When the developing device 630K supplies the toner to the surface of the photosensitive drum 610K, the electrostatic latent image is developed by the toner so as to form a toner image. The toner image on the surface of the photosensitive drum 610K is transferred onto the sheet W passing the transfer position YC of the photosensitive drum 610K by the transfer roller 640K to which voltage is applied. In the following explanations, the series of operations described above is referred to as an image formation operation.

The fixing device 700 fixes the toner image transferred on the sheet W. The discharge rollers 130 discharge the sheet W onto the discharge tray 120 via the outlet 110.

The process section 600K further includes a cleaning device 650K and a cleaning blade 660K. The cleaning device 650K is located to be in contact with the charging roller 620K at a position shifted from the charging position YA (or, at a position shifted from a nip position between the photosensitive drum 610K and the charging roller 620K). The cleaning device 650K performs a cleaning operation for cleaning the surface of the charging roller 620K. The cleaning blade 660K is a flexible member. The cleaning blade 660K is positioned so as to be in contact with a partial surface of the photosensitive drum 610K that is moving toward the charging position YA (the nip position between the photosensitive drum 610K and the charging roller 620K) from the transfer position YC (a nip position between the photosensitive drum 610K and the belt 331) according to the rotation of the photosensitive drum 610K. The cleaning blade 660K is a plate shaped rubber. The cleaning blade 660K is in contact with the photosensitive drum 610K so as to extend toward downstream side of a rotational direction of the photosensitive drum 610K that is defined at a contact position between the cleaning blade 660K and the photosensitive drum 610K. The cleaning blade 660K removes the tonner that is adhered on the photosensitive drum 610K when the image formation operation is performed. Further, the cleaning blade 660K performs operations for scraping the surface of the photosensitive drum 610K. In the embodiment, a "scraping operation" indicates, among the operations for scraping the surface of the photosensitive drum 610, an operation performed under at least one of: a condition that an absolute value of a charging current IC flowing in the charging roller 620K is lower than when the image forming operation is performed; and a condition that an absolute value of a transferring current IT flowing in the transfer roller 640K is lower than when the image forming operation is performed. The cleaning blade 660 is an example of a scraper. The cleaning blade 660K for black is an example of a first scraper. The cleaning blades 660Y, 660M, and 660C for yellow, magenta, and cyan are examples of a second scraper.

The printer 10 includes a temperature sensor 850 and a humidity sensor 860 (FIG. 1). Both the temperature sensor 850 and the humidity sensor 860 are provided at vicinity of the process section 600 in the main casing 100. The temperature sensor 850 outputs temperature detection signal SO1 (FIG. 2) depending on temperature TA that is temperature in the main casing 100. A controller 800 (described later) acquires a value of the temperature TA from the temperature detection signal SO1. The humidity sensor 860 outputs humidity detection signal SS1 depending on humidity SA that is humidity in the main casing 100. The controller 800 acquires a value of the humidity SA from the humidity detection signal SS1.

FIG. 2 is a block diagram illustrating electrical structures of the printer 10. The printer 10 includes the controller 800, a motor 811, a display 820, an operation interface 830, and a communication interface 840 in addition to the sheet supply section 200, the belt conveyance section 300, the image forming section 400, the temperature sensor 850, and the humidity sensor 860. The controller 800 is an example of a controller.

The controller 800 includes a CPU 801, a ROM 802, a RAM 803, a nonvolatile memory 804, an ASIC (Application Specific Integrated Circuit) 805, and a motor drive section 800. The ROM 802 stores a control program for controlling the printer 10 and information for each setting. The RAM 803 is used as a work area for performing each program, or as a storage area for temporarily storing data. The nonvolatile memory 804 is a rewritable memory such as an NVRAM, a flash memory, an HDD, and an EEPROM. The ASIC 805 is a hardware circuit for image process. The CPU 801 controls each components in the printer 10 according to signal from each sensor and the control program read from the ROM 802. The motor drive section 810 drives the motor 811.

The motor 811 drives rotations of the pickup roller 220, the registration rollers 240, the drive roller 332, and the photosensitive drums 610. The display 820 is configured of a liquid crystal display for example. The display 820 displays various information according to the instructions from the controller 800. The operation interface 830 includes various buttons for receiving operations or execution instructions by the user. The communication interface 840 is hardware enabling communications with external apparatuses. The communication interface 840 is a network interface, a serial communication interface, or a parallel communication interface for example.

Each of the process sections 600 for black, yellow, magenta and cyan includes a charging voltage application section 625, a developing voltage application section 635, a transferring voltage application section 645, current sensors 623 and 643, and voltage sensors 624 and 644. In FIG. 2, the process sections 600K and 600M for black and magenta are illustrated as representatives and other process sections 600Y and 600C are omitted. In the following, only the process section 600K will be explained. The process sections 600 for remaining colors have the same configuration of the process section 600K except colors of toner used therein.

The controller 800 performs a charging voltage application operation in which a charging voltage VC is applied to the charging roller 620K via the charging voltage application section 625K so that the charging voltage VC has the same polarity as that of the toner in the developing device 630K. In the embodiment, the charging voltage VC is set between +1 kV and +2 kV for example. The controller 800 performs a developing voltage application operation in which a developing voltage VD is applied to the developing device 630K via the developing voltage application section 635K so that the developing voltage VD has the same polarity as that of the toner in the developing device 630K. The developing voltage VD is set between +400 kV and +450 kV for example. The controller 800 performs a transferring voltage application operation in which a transferring voltage VT is applied to the transfer roller 640K via the transferring voltage application section 645K so that the transferring voltage VT has the opposite polarity to that of the toner in the developing device 630K. That is, the polarity of the transferring voltage VT is opposite to that of the charging voltage VC.

The current sensor 623K is connected between the charging voltage application section 625K and the charging roller 620K. The current sensor 623K outputs to the controller 800 current detection signal SG1 that depends on a value of the charging current IC flowing in the charging roller 620K. The controller 800 acquires an absolute value of the charging current IC (hereinafter, referred to simply as the "value of charging current IC") on the basis of the current detection signal SG1 to the controller 800. The voltage sensor 624K is connected between ground and a point P1. Here, the point P1 is between the charging voltage application section 625K and the charging roller 620K. The voltage sensor 624K outputs to the controller 800 voltage detection signal SG2 that depends on the charging voltage VC applied to the charging roller 620K. The controller 800 acquires a value of the charging voltage VC on the basis of the voltage detection signal SG2.

The current sensor 643K is connected between the transferring voltage application section 645K and the transfer roller 640K. The current sensor 643K outputs to the controller 800 current detection signal SG3 that depends on a value of the transferring current IT flowing in the transfer roller 640K. The controller 800 acquires an absolute value of the transferring current IT (hereinafter, referred to simply as the "value of transferring current IT") on the basis of the current detection signal SG3. The voltage sensor 644K is connected between the ground and a point P2. Here, the point P2 is between the transferring voltage application section 645K and the transfer roller 640K. The voltage sensor 644K outputs to the controller 800 voltage detection signal SG4 that depends on the transferring voltage VT applied to the transfer roller 640K. The controller 800 acquires a value of the transferring voltage VT on the basis of the voltage detection signal SG4.

Figure 3:
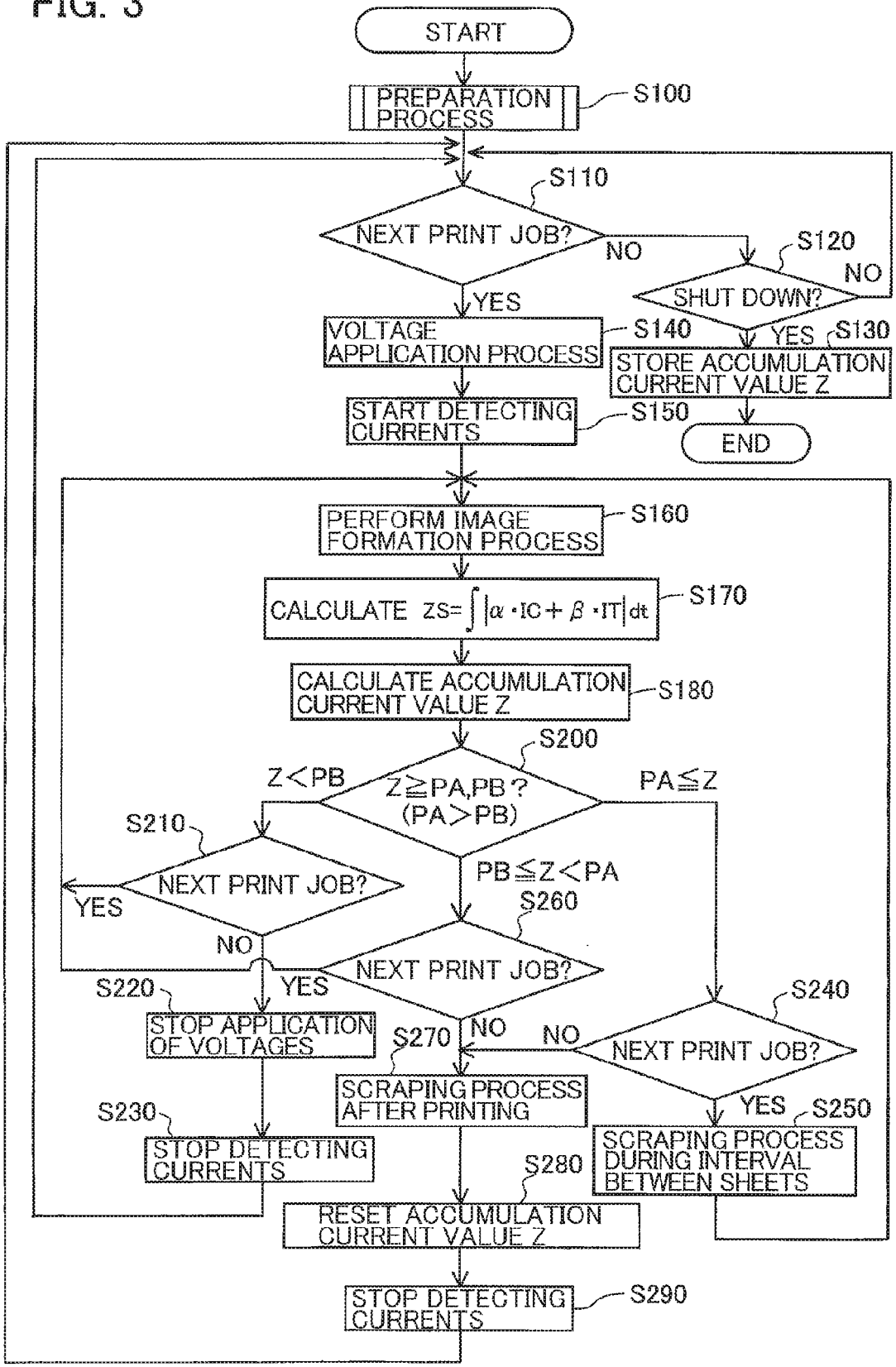
FIG. 3 is a flowchart illustrating a control process according to the embodiment.
Figure 4:
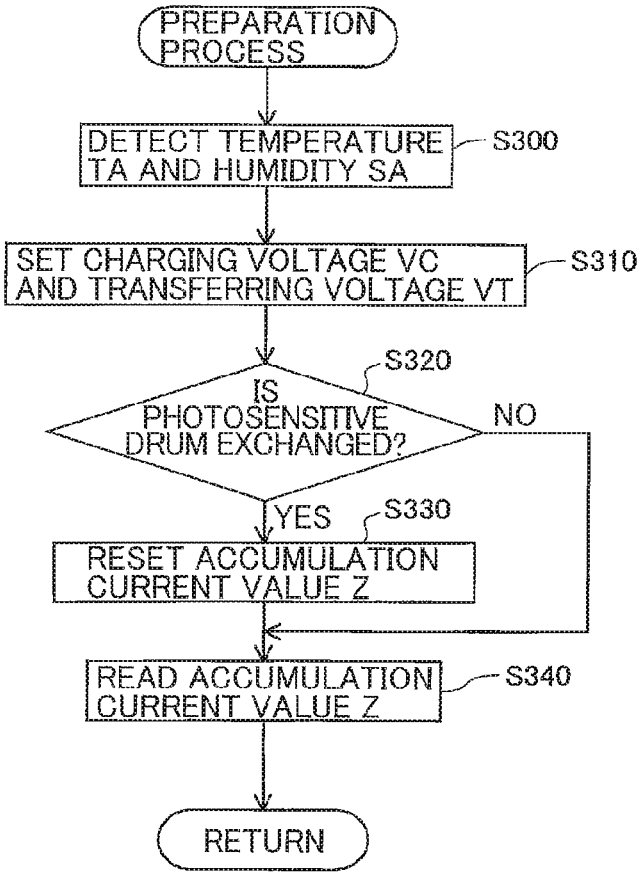
FIG. 4 is a flowchart illustrating a preparation process according to the embodiment.

A control process performed by the controller 800 will be explained. FIG. 3 is a flowchart illustrating the control process. The controller 800 starts the control process when the user turns on the printer 10 by operating the operation interface 830. As shown in FIG. 3, in S100 the controller 800 executes the preparation process when the control process starts. FIG. 4 is a flowchart illustrating a preparation process.

As shown in FIG. 4, in S300 of the preparation process the controller 800 detects the temperature TA and the humidity SA by using the temperature sensor 850 and the humidity sensor 860. In S310 the controller 800 sets a value of the charging voltage VC and a value a value of the transferring voltage VT. In the printer 10, as at least one of the temperature TA and the humidity SA becomes lower, electric resistance of the transfer roller 640 increases, causing the value of the charging current IC and the value of the transferring current IT to become smaller. The controller 800 sets the value of the charging voltage VC and the value of the transferring voltage VT so that the smaller at least one of the acquired values of the temperature TA and the humidity SA is, the larger at least one of the values of the charging voltage VC and the transferring voltage VT is. Accordingly, the value of the charging current IC and the value of the transferring current IT can be controlled to be constant regardless of the temperature TA and the humidity SA.

In S320 the controller 800 determines whether the photosensitive drum 610 is exchanged to new one for each of the process sections 600 of colors of black, yellow, magenta, and cyan. Each process section 600 has a detection section (not shown) for detecting whether the photosensitive drum 610 is unused one. The controller 800 can determine whether the photosensitive drum 610 is exchanged to new one on the basis of signal outputted from the corresponding detection section of the process section 600. When the controller 800 determines that the photosensitive drum 610 is exchanged to new one (S320: YES), in S330 the controller 800 resets an accumulation current value Z stored in the nonvolatile memory 804 to a value "0" and proceeds to S340. Specifically, the nonvolatile memory 804 stores the four accumulation current values Z for respective colors of black, yellow, magenta, and cyan. In other words, the accumulation current value accumulation current value Z is calculated and stored for each of the four process sections 600. When the controller 800 determines that the photosensitive drum 610 of one color is new one, the controller 800 resets the accumulation current value Z for the one color to a value "0". The controller 800 performs the reset of the accumulation current value Z for the color whose photosensitive drum 610 is determined to new one. The controller 800 repeatedly determines whether the photosensitive drum 610 is new one for each of black, yellow, magenta, and cyan, and resets, to the value "0", the accumulation current value Z corresponding to the photosensitive drum 610 that is determined to new one. When the controller 800 determines that no photosensitive drum 610 is exchanged to new one (S320: NO), the controller 800 proceeds to S340 without resetting the accumulation current value Z to the value "0". In S340 the controller 800 reads the accumulation current value Z for each of the process sections 600 of black, yellow, magenta, and cyan from the nonvolatile memory 804, and stores, in the RAM 803, the read accumulation current values Z as accumulation current values ZK for a previous print job and ends the preparation process.

After completing the preparation process, in S110 of the control process (FIG. 3) the controller 800 determines whether there is a next print job. The controller 800 determines that there is the next print job, when the controller 800 determines that a print job, which is an execution instruction for forming an image on the sheets W, is received via the communication interface 840 or the operation interface 830, for example. When there is the next print job (S110: YES), in S140 the controller 800 performs a voltage application process. In the voltage application process, the controller 800 performs the charging voltage application operation, the developing voltage application operation, and the transferring voltage application operation on the basis of the set value of the charging voltage VC and the set value of the transferring voltage VT.

When the charging voltage application and the transferring voltage application operation are executed, in S150 the controller 800 starts detecting a value of the charging current IC and a value of the transferring current IT for each of the process sections 600 of the black, yellow, magenta, and cyan. The controller 800 acquires a value of the charging current IC and a value of the transferring current IT every time a prescribed interval elapses from a timing T1 (FIG. 5) when at least the charging voltage application operation and the transferring voltage application operation starts, and stores the acquired values of the charging current IC and the transferring current IT in the RAM 803. The timing T1 is an example of a prescribed timing.

In S160 the controller 800 performs an image formation process. In the image formation process, the controller 800 performs an image formation operation for the number of sheets W designated to the print job that is the target of the current image formation operation (hereinafter, referred to as the "present print job").

After completing the image formation process, in S170 the controller 800 calculates an accumulation current value ZS on the basis of the values of the charging current IC and the transferring current IT stored in the RAM 803 for each of the process sections 600 of black, yellow, cyan, and magenta. Specifically, the controller 800 calculates a summation current value by summing a product of a charging correction coefficient α and the value of the charging current IC and a product of a transferring correction coefficient β and the value of the transferring current IT. The summation current value is calculated for each timing of acquisition of the values transferring current IT and the charging current IC from the timing T1 when detection of the values of the charging current IC and the transferring current IT are started to a timing T2 when the current image formation process ends. The controller 800 integrates the summation current value over time from the timing T1 to the timing T2 to calculate the accumulation current value ZS of the present print job.

Figure 5:
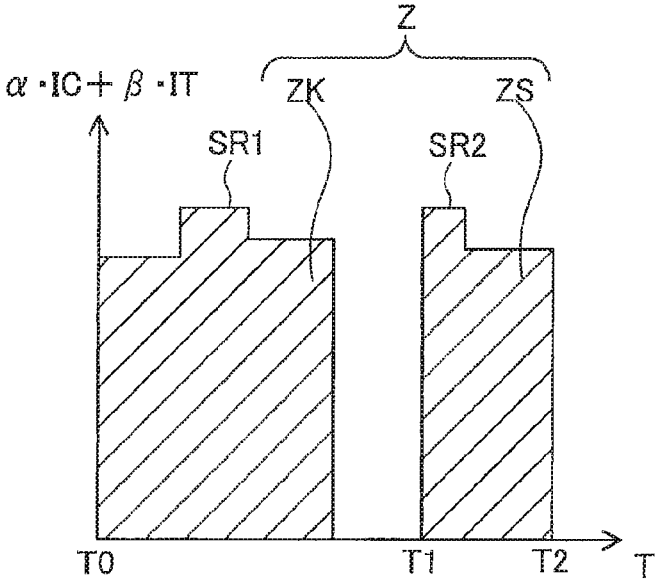
FIG. 5 is a timing chart illustrating change in a summation current value.

FIG. 5 is a timing chart showing change in the summation current value. In FIG. 5 an area of a hatched region SR2 indicates a definite integral of the summation current value (a value obtained by integral of the summation current value) from the timing T1 and to the timing T2. That is, the area of the hatched region SR2 corresponds to the accumulation current value ZS of the present print job.

The charging correction coefficient α and the transferring correction coefficient β are preset positive coefficients previously stored in the ROM 802. In a case of the present embodiment where the charging voltage VC is a positive value, the charging correction coefficient α is set to be larger than the transferring correction coefficient β. Specifically, the charging correction coefficient α is 1 and the transferring correction coefficient β is 0.5. In a case where the charging voltage VC is a negative value, the transferring correction coefficient β is set to be larger than the charging correction coefficient α.

The accumulation current value ZS is correlated with an accumulated charging current value and an accumulated transferring current value. Here, the accumulated charging current value is a result of integral of the charging current IC over time from the timing T1 to the timing T2. The accumulated transferring current value is a result of integral of the transferring current IT over time from the timing T1 to the timing T2. The accumulated charging current value may a result of integral of an absolute value of the charging current IC over time from the timing T1 to the timing T2. The accumulated transferring current value is a result of integral of an absolute value of the transferring current IT over time from the timing T1 to the timing T2. The controller 800 may calculate the accumulation current value ZS by calculating the accumulated charging current value and the accumulated transferring current value, and then summing a product of the accumulated charging current value and the charging correction coefficient α and a product of the accumulated transferring current value and the transferring correction coefficient β.

In S180 the controller 800 calculates the accumulation current value Z by summing the calculated accumulation current value ZS of the present print job and the accumulation current value ZK of the previous print job stored in the RAM 803 for each process section 600. Each accumulation current value ZK of the previous print job is a result of integral of the summation current value over time from a timing T0 to the timing T1. Here, the timing T0 indicates a timing when use of the printer 10 is started. Or, if the photosensitive drum 610 is exchanged to new one, the timing T0 indicates a timing when the photosensitive drum 610 is exchanged to new one after use of the printer 10 is started. Accordingly, the accumulation current value Z is a result of integral of the summation current value over time from the timing T0 to the timing T2. As shown in FIG. 5, the accumulation current values ZK of the previous print job corresponds to an area of a hatched region SR1 that calculated by integration of the summation current value over time from the timing T0 to the timing T1. The accumulation current value Z is a sum of the area of the hatched region SR1 and the area of the hatched region SR2. The accumulation current value Z is a total accumulation current value for print jobs up to the end of the present print job. The controller 800 stores the calculated accumulation current value Z in the RAM 803.

In S200 the controller 800 determines whether the calculated accumulation current value Z is larger than or equal to a threshold value PA and determines whether the calculated accumulation current value Z is larger than or equal to a threshold value PB. The threshold value PA is a positive value determined from a coefficient of dynamic friction with respect to surface of the photosensitive drum 610. Specifically, the threshold value PA is set on the basis of a threshold value KT. The threshold value KT is a coefficient of dynamic friction that does not influence on a quality of an image formed on a sheet W. The threshold value PB is a positive value smaller than the threshold value PA. Specifically, the threshold value PB is determined so that a difference between the threshold value PA and the threshold value PB is a reference value. When the accumulation current value Z is smaller than threshold value PA and larger than or equal to the threshold value PB, the difference between the threshold value PA and the accumulation current value Z is smaller than or equal to the reference value. The reference value is determined on the basis of an average of increased amounts of the accumulation current value Z. Here, each of the increased amounts of the accumulation current value Z is an increased amount of the accumulation current value Z while the image formation operations for 250 number of sheets W are performed.

When the accumulation current value Z is smaller than the threshold value PB for each process section 600, that is, all the accumulation current value Z is smaller than the threshold value PB (S200: Z<PB), the controller 800 proceeds to S210. That is, when a largest accumulation current value Z is smaller than threshold value PB, the controller 800 proceeds to S210. In S210 the controller 800 determines whether there is a next print job. When there is the next print job (S210: YES), the controller 800 repeats the processes from S160. When there is no next print job (S210: NO), in S220 the controller 800 stops applications of the charging voltage VC, the developing voltage VD, and the transferring voltage VT. In S230 the controller 800 stops detecting the values of the charging current IC and the transferring current IT, and repeats the processes from S110.

When at least one accumulation current value Z (or largest accumulation current value Z) is larger than or equal to the threshold value PA among the accumulation current value Z for the process section 600 of colors black, yellow, magenta, and cyan (S200: PA≤Z), in S240 the controller 800 determines whether there is a next print job. When there is the next print job (S240: YES), in S250 the controller 800 performs a scraping process during an interval between sheets for all the process sections 600 for black, yellow, magenta, and cyan. That is, all the photosensitive drums 610 are scraped by the respective cleaning blades 660. The scraping process during the interval between sheets performs, for each process section 600, a scraping operation for scraping the surface of the photosensitive drum 610 before the execution of the next print job, specifically, in a period after a last sheet W of the present print job passes the transfer position YC and before a first sheet W of the next print job passes the transfer position YC.

Figure 6:
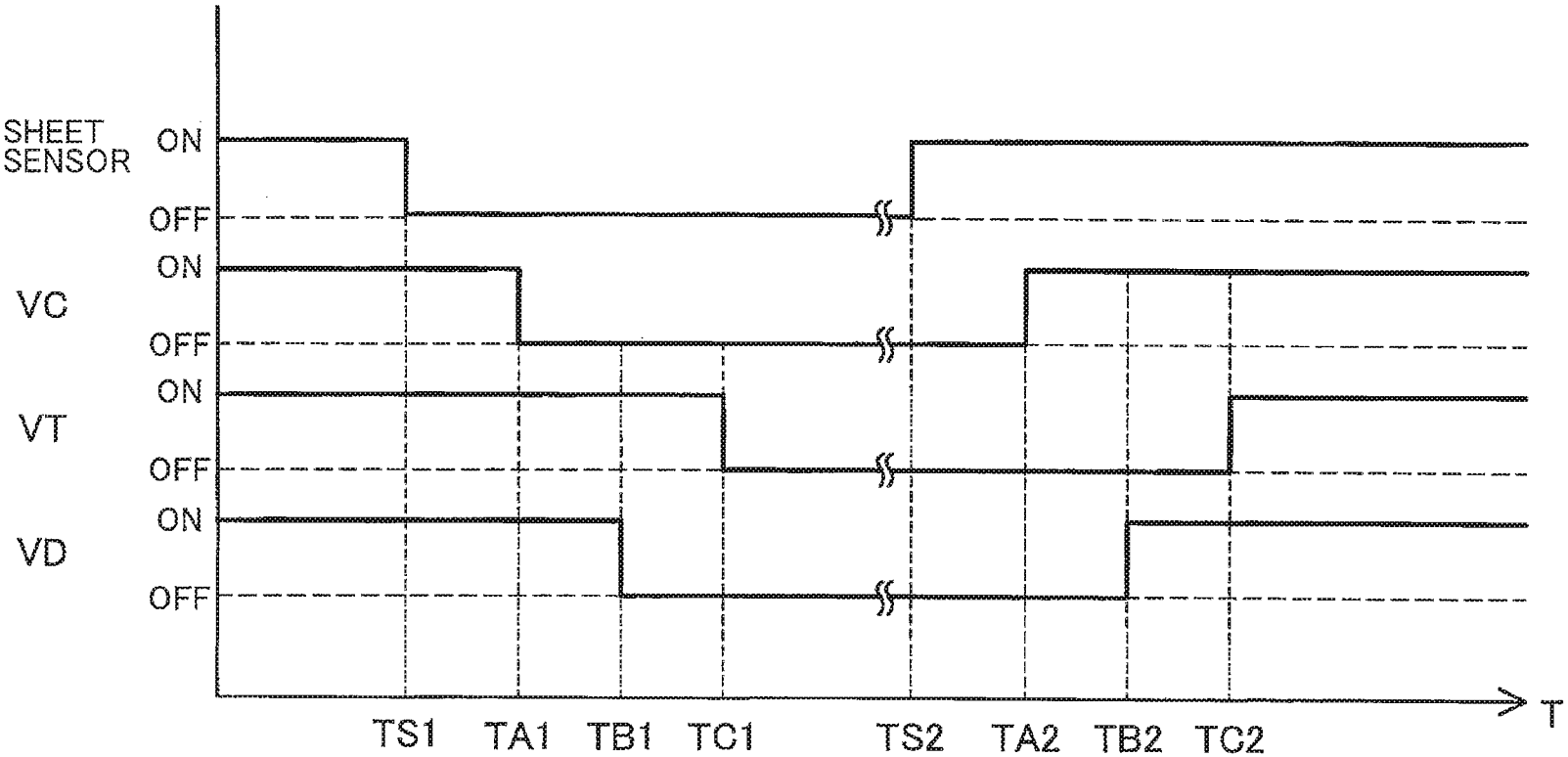
FIG. 6 is a timing chart illustrating a charging voltage, a developing voltage, a transferring voltage, and detection results by a sheet sensor.
Figure 7:
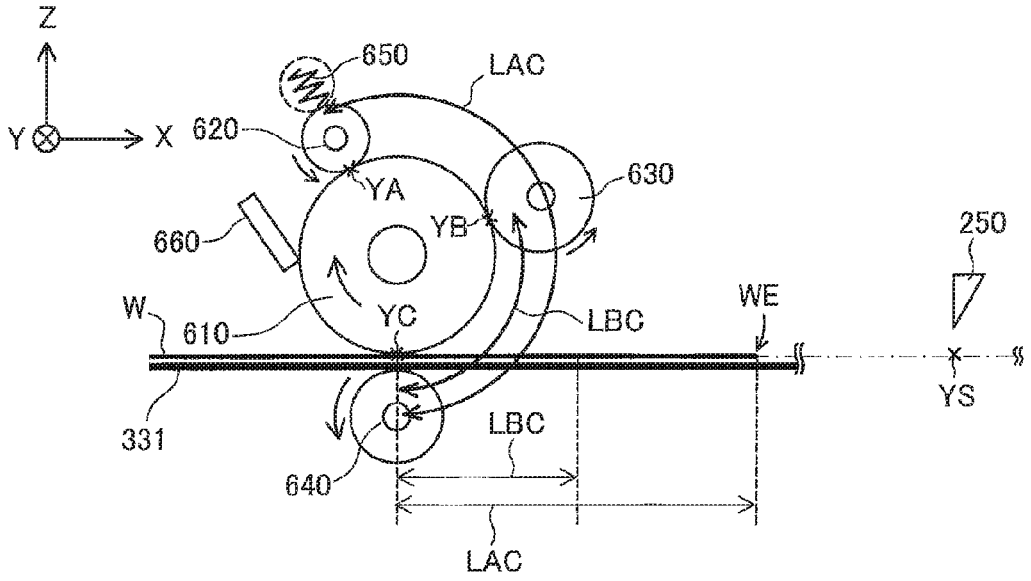
FIG. 7 is a schematic diagram illustrating a relation among a distance between a charging position and a transfer position, a distance between a developing position and a transfer position, and a sheet.

FIG. 6 is a timing chart illustrating a detection result of the sheet sensor 250 in the scraping process during the interval between sheets and changes in the charging voltage VC, the developing voltage VD, and the transferring voltage VT. FIG. 7 is a schematic diagram illustrating a relation between sheets W, a distance LAC, and a distance LBC. The distance LAC is a distance along the surface of the photosensitive drum 610 in the rotational direction of the photosensitive drum 610 from the charging position YA to the transfer position YC. The distance LBC is a distance along the surface of the photosensitive drum 610 in the rotational direction of the photosensitive drum 610 from the developing position YB to the transfer position YC. The distance LBC is shorter than the distance LAC.

In the scraping process during the interval between sheets for one process section 600, at the timing TS1 (FIG. 6) the controller 800 detects that a trailing edge WE of the last sheet in the present print job in the conveying direction arrives at the detection position YS. When the controller 800 detects that the trailing edge WE arrives at the detection position YS, the controller 800 performs an application stop process for stopping applications of the charging voltage VC, the developing voltage VD, and the transferring voltage VT. In the application stop process, the controller 800 stops application of the charging voltage VC to the charging roller 620 at a timing TA1 when the trailing edge WE arrives at a position upstream of the transfer position YC in the conveying direction by the distance LAC. Accordingly, the value of the charging current IC becomes zero.

Next, the controller 800 stops application of the developing voltage VD to the developing device 630 at a timing TB1 when the trailing edge WE arrives at a position upstream of the transfer position YC in the conveying direction by the distance LBC. Because the distance LBC is shorter than the distance LAC as shown in FIG. 7, the timing TB1 follows the timing TA1.

Subsequently, the controller 800 stops application of the transferring voltage VT to the transfer roller 640 at a timing TC1 when the trailing edge WE arrives at the transfer position YC. Accordingly, the value of the transferring current IT becomes zero. As shown in FIG. 6, the timing TC1 follows the timing TB1. In other words, in the application stop process, the controller 800 stops the applications of the charging voltage VC, the developing voltage VD, and the transferring voltage VT in this order. In the application stop process, the controller 800 stops the applications of the charging voltage VC, the developing voltage VD, and the transferring voltage VT so that a first region, a second region, and a third region coincide with each other. Here, the first region is a region on the surface of the photosensitive drum 610 positioned at the charging position YA at the timing TA1. The second region is a region on the surface of the photosensitive drum 610 positioned at the developing position YB at the timing TB1. The third region is a region on the surface of the photosensitive drum 610 positioned at the transfer position YC at the timing TC1.

After completing the application stop process, the controller 800 performs a scraping operation of the surface of the photosensitive drum 610 until a leading edge of the first sheet W in the next print job in the conveying direction arrives at the detection position YS. In the scraping operation, the controller 800 controls the photosensitive drum 610 to rotate first rotation number of times. Accordingly, the surface of the photosensitive drum 610 is scraped by the cleaning blade 660 that is located in contact with the surface of the photosensitive drum 610. In the embodiment, the scraping operation is performed in a state where both the charging current IC and the transferring current IT are zero, that is, in a state where the charging current IC is lower than that when the image formation operation is performed and the transferring current IT is lower than that when the image formation operation is performed. In the scraping operation, the controller 800 maintains the contact position of the developing device 630 to the photosensitive drum 610. Accordingly, the transferring current and electric charge of the photosensitive drum 610, which increase the coefficient of dynamic friction, can be suppressed, whereby the scraping operation is performed while suppressing increase of the coefficient of dynamic friction. The photosensitive drum 610 can be scraped more efficiently than a conceivable case where values of the charging current IC and the transferring current IT are the same as those in the image formation operation.

When the controller 800 detects that the leading edge of the sheet W arrives at the detection position YS at a timing TS2 shown in FIG. 6, the controller 800 performs a reapplication process. In the reapplication process, the controller 800 performs a charging voltage application operation at a timing TA2 when the leading edge arrives at a position upstream of the transfer position YC in the conveying direction by the distance LAC. The controller 800 performs a developing voltage application operation at a timing TB2 when the leading edge arrives at a position upstream of the transfer position YC in the conveying direction by the distance LBC. The controller 800 performs a transferring voltage application operation at a timing TC2 when the leading edge arrives at the transfer position YC. In other words, in the reapplication process, the controller 800 restarts applications of the charging voltage VC, the developing voltage VD, and the transferring voltage VT in this order. In the reapplication process, the controller 800 restarts the applications of the charging voltage VC, the developing voltage VD, and the transferring voltage VT so that a fourth region, a fifth region, and a sixth region coincide with each other. Here, the fourth region is a region on the surface of the photosensitive drum 610 positioned at the charging position YA at the timing TA2. The fifth region is a region on the surface of the photosensitive drum 610 positioned at the developing position YB at the timing TB2. The sixth region is a region on the surface of the photosensitive drum 610 positioned at the transfer position YC at the timing TC2. After completing the scraping process during the interval between sheets, the controller 800 repeats the processes from S160.

When there is no next job (S240: NO), in S270 the controller 800 performs a scraping process after printing for all the process sections 600 for black, yellow, magenta, and cyan. The scraping process after printing performs, for each process section 600, a scraping operation for scraping the surface of all the photosensitive drums 610 after completing the present print job, that is, after the last sheet W of the print job passes the transfer position YC.

In the scraping process after printing, the controller 800 stops the applications of the charging voltage VC, the developing voltage VD, and the transferring voltage VT to the charging roller 620 after a prescribed time period elapses. Subsequently, the controller 800 performs a scraping operation for the surface of the photosensitive drum 610. In the scraping operation, the controller 800 controls the developing device 630 to move from the contact position to the separation position and controls the photosensitive drum 610 to rotate in second rotation number of times. The second rotation number is five rotations of the photosensitive drum 610 for example, and is larger than the first rotation number. The developing device 630 is separated from the photosensitive drum 610, whereby unnecessary toner can be prevented from adhering to the photosensitive drum 610 from the developing device 630 and life of the developing device 630 can be prolonged. In the scraping process after printing, the photosensitive drum 610 can be scraped in a period larger than that of the scraping process during the interval between sheets. After completing the scraping process after printing, in S280 the controller 800 resets all the accumulation current values Z stored in the RAM 803 and the nonvolatile memory 804. In S290 the controller 800 ends detecting the values of the charging current IC and the transferring current IT, and repeats the processes from S110.

When all the accumulation current values Z are smaller than the threshold value PA and at least one accumulation current value Z is larger than or equal to the threshold value PB (S200: PB≤Z<PA), the controller 800 proceeds to S260. That is, when a largest accumulation current value Z is smaller than threshold value PA and larger than or equal to the threshold value PB, the controller 800 proceeds to S260, in S260 the controller 800 determines whether there is a next print job. When there is the next print job (S260: YES), the controller 800 repeats the processes from S160. When there is no next print job (S260: NO), in S270 the controller 800 performs the scraping process after printing as described above.

When there is no next print job (S110: NO), in S120 the controller 800 determines whether shutdown instructions for turning off the printer 10 are received via the operation interface 830. When the shutdown instructions are not received (S120: NO), the controller 800 repeats the processes from S110. When the shutdown instructions are received (S120: YES), in S130 the controller 800 copies the accumulation current value Z for each process section 600 that is stored in the RAM 803 to the nonvolatile memory 804, and ends the control process.

The inventors of the present application make experiments to specify cause of increase of the coefficient of dynamic friction. According to the experiments, the inventors obtain results indicating that there is a correlation between the coefficient of dynamic friction of the surface of the photosensitive drum 610 and a result of integration of the current that flows between the photosensitive drum 610 and components to which voltage are applied. The exact reason of this correlation is not specified. However, the inventors estimate that the coefficient of dynamic friction increases because small amount on corona discharge on the surface of the photosensitive drum 610 generates products and the generated products adheres to the surface of the photosensitive drum 610. The inventors find that there is a correlation between the coefficient of dynamic friction of the surface of the photosensitive drum 610 and the result of integrals of the charging current IC and the transferring current IT over time.

In the embodiment, on the basis of the above correlation obtained by the experiments, the controller 800 calculates the accumulation current value Z that is correlated to the integration result of the charging current IC and the transferring current IT. When the accumulation current value Z is larger than or equal to the threshold value PA, the scraping operation is performed for scraping the surface of the photosensitive drum 610. Accordingly the products generated by the corona discharge can be removed. The coefficient of dynamic friction can be prevented from exceeding the threshold value KT.

Figure 8:
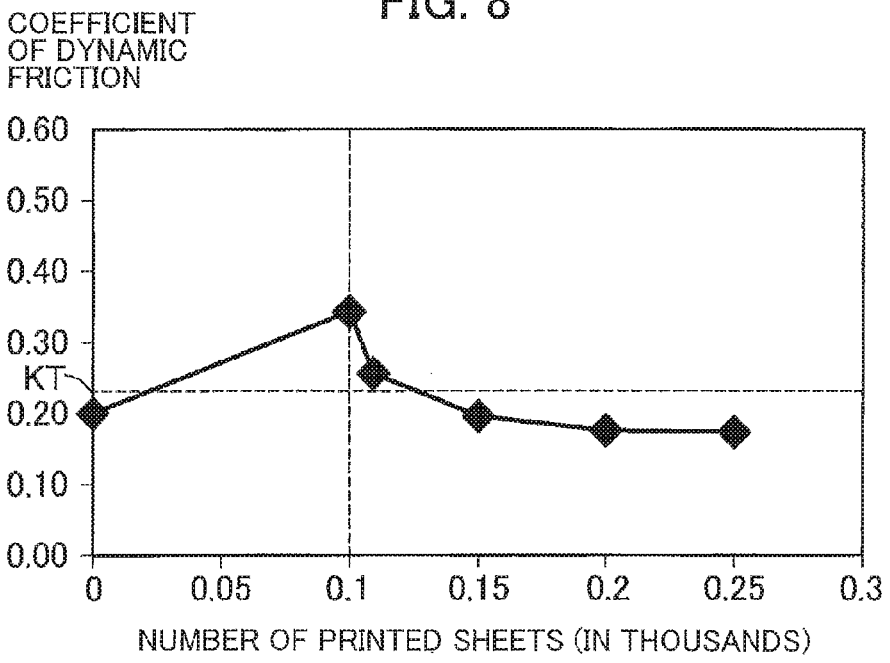
FIG. 8 is a graph illustrating a relation between number of printed sheets and coefficients of dynamic friction.

FIG. 8 is a graph showing a relation between the number of printed sheets and the coefficient of dynamic friction of the surface of the photosensitive drum 610. As shown in FIG. 8, the scraping operation is not performed until the number of printed sheets becomes 100. After the number of printed sheets is greater than or equal to 100, the scraping operation based on the accumulation current value Z is performed. The coefficient of dynamic friction of the surface of the photosensitive drum 610 exceeds the threshold value KT and gradually increases until the number of printed sheets becomes 100. After the number of printed sheets is greater than or equal to 100, the coefficient of dynamic friction decreases, whereby the coefficient of dynamic friction can be prevented from exceeding the threshold value KT.

The accumulation current value Z is calculated by integration of the charging current IC and the transferring current IT over time, and thus it is estimated that the accumulation current value Z is less influenced by change in viscosity of lubricant applied around the axis of the photosensitive drum 610 than the torque of the photosensitive drum 610. The configuration according to the embodiment can reduce unnecessary scraping operation, which would be performed when the coefficient of dynamic friction would be too small to affect the image, and in which the surface of the photosensitive drum 610 would be unnecessary grinded, more efficiently than a case where the surface of the photosensitive member is scraped when the torque current arrives at a prescribed value.

In the embodiment, the accumulation current value Z is calculated from both the integration results of the charging current IC and the transferring current IT over time. Accordingly, degradation of the image quality can be reduced while preventing unnecessary scraping operation, more efficiently than the case only one of the integration results is used for calculating an accumulation current value Z.

The inventors of the present application make experiments to specify causality between increase of dynamic friction coefficient of the surface of the photosensitive drum 610 and polarity of the charging voltage VC. According to the experiments, the inventors find that the there is a strong correlation between the dynamic friction coefficient of the surface of the photosensitive drum 610 and the integration result of the charging current IC over time when the charging voltage VC is positive. The inventors also finds that the there is a strong correlation between the dynamic friction coefficient of the surface of the photosensitive drum 610 and the integration result of the transferring current IT over time when the charging voltage VC is negative.

On the basis of the experimental results, in the embodiment, the charging correction coefficient $\alpha$ is set to be larger than the transferring correction coefficient $\beta$ when the charging voltage VC has a positive polarity. The transferring correction coefficient $\beta$ is set to be larger than the charging correction coefficient $\alpha$ when the charging voltage VC has a negative polarity. Accordingly, degradation of the image quality can be reduced while preventing unnecessary scraping operation, more efficiently than the case where both the charging correction coefficient $\alpha$ and the transferring correction coefficient $\beta$ are constant, that is, are determined without considering the polarity of the charging voltage VC.

In the embodiment, the accumulation current value Z is calculated for each of the process sections 600 of black, yellow, magenta, and cyan, and then the scraping process during the interval between sheets or the scraping process after printing is also performed for all the process sections 600. The execution of scraping process can be determined on the basis of the largest accumulation current value Z among the four accumulation current values Z calculated for the four process section 600.

In the embodiment, all the accumulation current values Z are reset to the value "0" in response to completion of the scraping process after printing. So, when the coefficient of dynamic frictions for all the photosensitive drums 610 are reduced, all the accumulation current values Z can be calculated from "0".

In the embodiment, the accumulation current values Z before the printer 10 is turned OFF are stored in the nonvolatile memory 804. In the subsequent process after the printer 10 is turned ON again, the stored accumulation current values Z are used for calculating accumulation current values Z. Accordingly, errors can be reduced more efficiently than a case where the accumulation current value Z before the printer 10 is turned OFF is not used in the subsequent process.

In the embodiment, when the photosensitive drum 610 is exchanged to new one, the accumulation current value Z corresponding to the exchanged photosensitive drum 610 is reset to "0". The accumulation current value Z corresponding to the exchanged photosensitive drum 610 can be calculated from the value "0", thereby reducing error when calculating the accumulation current value Z.

In the embodiment, when the accumulation current value Z is greater than or equal to the threshold value PA, and there is a next print job, the scraping process during the interval between sheets is executed for the scraping operations on the surfaces of the photosensitive drums 610 before execution of the next print job. Accordingly, degradation of the image quality can be prevented in the next print job more efficiently than a case where the scraping operation is executed after completion of the next print job.

When the accumulation current value Z is greater than or equal to the threshold value PB and smaller than the threshold value PA and there is no next print job, the scraping process after printing performs executing the scraping operation on the surface of the photosensitive drum 610 after completing the present print job. When the accumulation current value Z is greater than or equal to the threshold value PB and smaller than the threshold value PA, that is, when the difference between the accumulation current value Z and the threshold value PA is smaller than or equal to the reference value, there is a possibility that the accumulation current value Z will become larger than or equal to the threshold value PA in a next print job if the scraping process after printing is not performed. In this case, the scraping process during the interval between sheets will be performed in the interval before execution of one after the next print job. However, because the interval is restricted, the scraping operation in the scraping process during the interval between sheets will be more complicated than the scraping process after printing. In the embodiment, when the accumulation current value Z is smaller than the threshold value PA and the difference between the accumulation current value Z and the threshold value PA is smaller than or equal to the reference value, the scraping process after printing is performed. Accordingly, the number of the scraping processes during the interval between sheets can be reduced, thereby preventing the scraping operation from being complicated.

While the disclosure has been described in detail with reference to the above embodiment, it would be apparent to those skilled in the art that various changes and modifications may be made thereto.

In the embodiment, as a scraper, the cleaning blade 660 is in contact with the surface of the photosensitive drum 610. However, the scraper is not limited to this. For example, the scraper may be movable between a contact position in which the scraper is in contact with the surface of the photosensitive drum 610 and a separation position in which the scraper is separated from the photosensitive drum 610. In this case, the scraping operation may indicate moving the scraper so as to be in contact with the surface of the photosensitive drum 610.

In the embodiment, the controller 800 acquires both the values of the charging current IC and the transferring current IT. However, the controller 800 may acquire either one of the values of the charging current IC and the transferring current IT.

In the embodiment, the accumulation current value Z is calculated using both the integration result of the charging current IC over time and the integration result of the transferring current IT over time. However, the accumulation current value Z may be calculated by using either one of the integration result of the charging current IC over time and the integration result of the transferring current IT over time.

In the embodiment, the detections of the values of the charging current IC and the transferring current IT are executed not only a period during the image formation process but also an interval between the present print job and the next print job when there is the next print job. However, the detections of the values of the charging current IC and the transferring current IT may be executed only the period during the image formation, for example. Note that the values of the charging current IC and the transferring current IT can be detected in a process within the interval between the present print job and the next print job when there is the next print job if the detections of the values of the charging current IC and the transferring current IT are executed both a period during the image formation process and an interval between the present print job and the next print job when there is the next print job.

In the embodiment, the charging voltage applied to the charging roller 620 (the charger) is a positive voltage that is the same polarity of the toner (positive polarity). However, the polarity of the toner may be negative, and the charging voltage may be a negative voltage to be the same polarity of the toner.

The threshold value PA and the threshold value PB are common values for all of the process sections 600 of black, yellow, magenta, and cyan. However, a specific threshold value PA and a specific threshold value PB may be set for each process section 600. That is, the threshold values PA may be defined to be specific for the respective process sections 600, and the plurality of threshold values PB may defined to be specific for the respective process sections 600.

In the embodiment, when at least one of the accumulation current values Z for the process sections 600 for colors of black, yellow, magenta, and cyan is larger than the threshold value (PA or PB), the scraping process (S250 or S270) is performed for all the process sections 600. However, the scraping process (S250 or S270) may be performed for only the process section(s) 600 that corresponds to accumulation current value(s) Z larger than the threshold value (PA or PB). In this case, the accumulation current value(s) Z, which corresponds to the process section(s) 600 for which the scraping process S270 was performed, may be reset to "0". In this case, when there is at least one accumulation current value Z satisfying PA≤Z, the process goes to S250 via S240. The scraping operation in S250 is performed for only on the photosensitive drum(s) 610 corresponding to the at least one accumulation current value Z satisfying PA≤Z. Alternatively, the scraping operation in S250 may be performed for only on the photosensitive drum(s) 610 corresponding to the at least one accumulation current value Z satisfying PA≤Z or PB≤Z<PA.

In the embodiment, the printer 10 includes both the temperature sensor 850 and the humidity sensor 860. However, the printer 10 may include either one of the temperature sensor 850 and the humidity sensor 860.

In the embodiment, the accumulation current values Z are reset to "0" after completing the scraping process after printing whereas the accumulation current values Z are not reset to "0" after completing the scraping process during the interval between sheets. However, the accumulation current values Z may be reset at least one of when the scraping process after printing is completed and when the scraping process after printing is completed. Alternatively, the accumulation current values Z may be reset to "0" after completing the scraping process after printing, and the accumulation current values Z may be reset to a value larger than "0" and smaller than the threshold value PB after completing the scraping process during the interval between sheets.

In the embodiment, the accumulation current values Z are reset to "0". However, the accumulation current value Z may be reset to an initial value other than "0". In this case the initial value may be smaller than the threshold value PB.

The configurations of the printer 10 according to the embodiment is just one example, and can be modified in various ways. For example, the printer 10 prints an image using toner of four colors black, yellow, magenta, and cyan in the embodiment. However, the colors of the toner and the number of the colors of toner may be changed.

The process of the embodiment may be performed by the single CPU 801, a plurality of CPUs, at least one ASIC, or any combinations thereof. The controller 800 is a general name of hardware, such as the CPU 801 used for controlling the printer 10 and does not necessarily indicate single hardware in the printer 10.

In the embodiment, the accumulation current values Z are calculated for colors of black, yellow, magenta, and cyan, and determination S200 is made by using all the accumulation current values Z. However, determination S200 may be performed by using at least one accumulation current Z. For example, in S200, the controller 800 may determine whether the accumulation current value Z for black (or the accumulation current value Z calculated for the process section 600K) is smaller than the threshold value PB and whether the accumulation current value Z for black is larger than or equal to the threshold value PA. When the accumulation current value Z for black is smaller than the threshold value PB, the process shifts S210. When the accumulation current value Z for black is larger than or equal to the threshold value PA, the process shifts to S240. When the accumulation current value Z for black is larger than or equal to the threshold value PB and smaller than the threshold value PA, the process shifts to S260. Alternatively, an accumulation current value Z may be calculated for one of colors of black, yellow, magenta, and cyan. For example, only an accumulation current value Z for black is calculated and the determination process S200 is performed by using only the accumulation current value Z for black.

What is claimed is:

1. An image forming apparatus comprising:

a photosensitive member on which a developer image is configured to be formed;

a charger through which a charging current is configured flow;

a developing device configured to supply developer to the photosensitive member;

a transfer device through which a transferring current is configured to flow;

a scraper configured to scrape the photosensitive member; and a controller configured to:

perform an image formation process to form the developer image on the photosensitive member by using the developing device;

acquire a value of the charging current flowing in the charger and a value of the transferring current flowing in the transfer device;

calculate an accumulation current value by using a first result of integration of an absolute value of the charging current value over time and a second result of integration of an absolute value of the transferring current value over time; and perform a scraping process in which the scraper scrapes the photosensitive member when the accumulation current value reaches a threshold value.

2. The image forming apparatus according to claim 1, wherein in the calculating, the controller is configured to calculate the accumulation current value by summing a product of a first correction coefficient and the first result and a product of a second correction coefficient and the second result.

3. The image forming apparatus according to claim 2, wherein the charger is applied with a positive charging voltage, and the transferring device is applied with a negative transferring voltage, wherein the first correction coefficient is larger than the second correction coefficient, and the second correction coefficient is larger than zero.

4. The image forming apparatus according to claim 2 wherein the charger is applied with a negative charging voltage, and the transferring device is applied with a positive transferring voltage, wherein the second correction coefficient is larger than the first correction coefficient, and the first correction coefficient is larger than zero.

5. The image forming apparatus according to claim 1, wherein the accumulation current is calculated during a time period in a present print job, wherein in the calculating, the controller is further configured to calculate a total accumulation current value by summing the accumulation current value and a previous accumulation current value calculated in a time period in a previous print job, wherein in the scraping, the controller is configured to perform the scraping process when the total accumulation current value reaches the threshold value.

6. The image forming apparatus according to claim 1, wherein the controller is further configured to reset the accumulation value to an initial value after the scraping process is performed.

7. The image forming apparatus according to claim 1, further comprising a main body, the photosensitive member being configured to be attached to and detached from the main body to exchange the photosensitive member for another photosensitive member, wherein the controller is configured to reset the accumulation value to an initial value when the photosensitive member is exchanged to the another photosensitive member.

8. The image forming apparatus according to claim 1, wherein in the scraping, when there is a next print job and the accumulation current value reaches the prescribed value, the controller is configured to perform the scraping process before executing the next print process.

9. The image forming apparatus according to claim 8, wherein when there is no next print job and a difference between the accumulation current value and the threshold value is smaller than or equal to a reference value, the controller is configured to perform the scraping process.

10. An image forming apparatus comprising:

a photosensitive member on which a developer image is configured to be formed;

a charger through which a charging current is configured flow;

a developing device configured to supply developer to the photosensitive member;

a transfer device through which a transferring current is configured to flow;

a scraper configured to scrape the photosensitive member, the scraper including an elastic plate in contact with the photosensitive member; and a controller configured to:

perform an image formation process to form the developer image on the photosensitive member by using the developing device;

acquire, as a first value, at least one of a value of the charging current flowing in the charger and a value of the transferring current flowing in the transfer device;

calculate an accumulation current value by using result of an integral of a second value over time, the second value being an absolute value of the first value; and perform a scraping process in which the scraper scrapes the photosensitive member when the accumulation current value reaches a threshold value, the controller configured to control the photosensitive member to rotate in the scraping process while the image formation process is not performed, the controller is configured to control the photosensitive member to rotate under at least one of a condition that an absolute value of the charging current is lower than that when the image formation process is performed, and a condition that an absolute value of the transferring current is lower than that when the image formation process is performed.

11. The image forming apparatus according to claim 10, wherein the controller is configured to move the developing device from a contact position at which the developing device is in contact with the photosensitive member to a separation position at which the developing device is separated from the photosensitive member.

12. An image forming apparatus comprising:

a photosensitive member on which a developer image is configured to be formed;

a charger through which a charging current is configured to flow;

a developing device configured to supply developer to the photosensitive member;

a transfer device through which a transferring current is configured to flow;

a cleaning blade disposed to be in contact with a photosensitive member;

a controller configured to:

supply the charger with the charging current;

control the developing device to supply the developer to the photosensitive member;

supply the developing device with the transferring current;

acquire, as a first value, at least one of a value of the charging current flowing in the charger and a value of the transferring current flowing in the transfer device;

calculate an accumulation current value by using result of an integral of a second value over time, the second value being an absolute value of the first value, wherein the accumulation current is calculated during a time period in a present print job, wherein the controller is configured to calculate a total accumulation current value by summing the accumulation current value and a previous accumulation current value calculated in a time period in a previous print job; and perform a scraping process in which the photosensitive member rotates while the charging current and the transferring current are reduced in a case where the accumulation current value reaches a threshold value, wherein the controller is configured to perform the scraping process when the total accumulation current value reaches the threshold value.

13. The image forming apparatus according to claim 12, wherein in the acquiring, the controller is configured to acquire both the value of charging current and the value of the transferring current, wherein in the calculating, the controller is configured to calculate the accumulation current by using a first result of integration of a third value over time and a second result of integration of a fourth value over time, the third value being an absolute value of the charging current and the fourth value being an absolute value of the transferring current.

14. The image forming apparatus according to claim 12, wherein the controller is further configured to reset the accumulation value to an initial value after the scraping process is performed.

15. The image forming apparatus according to claim 12, further comprising a main body, the photosensitive member being configured to be attached to and detached from the main body to exchange the photosensitive member for another photosensitive member, wherein the controller is configured to reset the accumulation value to an initial value when the photosensitive member is exchanged to the another photosensitive member.

16. The image forming apparatus according to claim 12, wherein the controller is configured to move the developing device from a contact position at which the developing device is in contact with the photosensitive member to a separation position at which the developing device is separated from the photosensitive member.

17. The image forming apparatus according to claim 10, wherein in the acquiring, the controller is configured to acquire both the value of charging current and the value of the transferring current, wherein in the calculating, the controller is configured to calculate the accumulation current by using a first result of integration of a third value over time and a second result of integration of a fourth value over time, the third value being an absolute value of the charging current and the fourth value being an absolute value of the transferring current.

18. The image forming apparatus according to claim 10, wherein the accumulation current is calculated during a time period in a present print job, wherein in the calculating, the controller is further configured to calculate a total accumulation current value by summing the accumulation current value and a previous accumulation current value calculated in a time period in a previous print job, wherein in the scraping, the controller is configured to perform the scraping process when the total accumulation current value reaches the threshold value.

19. The image forming apparatus according to claim 10, wherein the controller is further configured to reset the accumulation value to an initial value after the scraping process is performed.

20. The image forming apparatus according to claim 10, wherein in the scraping, when there is a next print job and the accumulation current value reaches the prescribed value, the controller is configured to perform the scraping process before executing the next print process.

* * * * *